US011952873B1

(12) United States Patent
El Mallawany et al.

(10) Patent No.: US 11,952,873 B1
(45) Date of Patent: Apr. 9, 2024

(54) WASHPIPE FREE FEATURE WITH BALL AND MAGNET

(71) Applicant: Halliburton Energy Services, Inc., Houston, TX (US)

(72) Inventors: Ibrahim El Mallawany, Al-Khobar (SA); Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/963,757

(22) Filed: Oct. 11, 2022

(51) Int. Cl.
*E21B 43/12* (2006.01)
*E21B 33/127* (2006.01)

(52) U.S. Cl.
CPC ..... *E21B 43/12* (2013.01); *E21B 33/1277* (2013.01); *E21B 2200/04* (2020.05)

(58) Field of Classification Search
CPC ... E21B 43/12; E21B 33/1277; E21B 2200/04
See application file for complete search history.

(56) References Cited

U.S. PATENT DOCUMENTS

| | | | | |
|---|---|---|---|---|
| 7,775,283 | B2 | 8/2010 | Coronado et al. | |
| 11,041,360 | B2 | 6/2021 | Penno et al. | |
| 11,066,909 | B2 | 7/2021 | Yin et al. | |
| 11,454,074 | B2 * | 9/2022 | Kellner | E21B 34/14 |
| 2008/0041588 | A1 | 2/2008 | Richards et al. | |
| 2011/0198097 | A1 | 8/2011 | Moen | |
| 2012/0181036 | A1 | 7/2012 | Holderman | |
| 2013/0000740 | A1 | 1/2013 | Veit | |
| 2013/0276901 | A1 * | 10/2013 | Holderman | E21B 34/103 137/12 |
| 2014/0034308 | A1 * | 2/2014 | Holderman | E21B 34/142 166/279 |
| 2019/0040699 | A1 * | 2/2019 | Perez | E21B 23/01 |
| 2021/0324715 | A1 * | 10/2021 | Yin | E21B 33/12 |

OTHER PUBLICATIONS

International Search Report and Written Opinion for International Patent Application No. PCT//US2022/048728 dated Jul. 11, 2023.

* cited by examiner

*Primary Examiner* — Yong-Suk (Philip) Ro
(74) *Attorney, Agent, or Firm* — Scott Richardson; C. Tumey Law Group PLLC

(57) ABSTRACT

A washpipe free feature may include a housing defining a chamber having a bypass portion and a securing portion. The housing has first and second bores to put the bypass portion in fluid communication with an annulus of a wellbore and a central bore of a downhole tubular, respectively. Further, the washpipe free feature includes a magnet secured in the bypass portion, a ferromagnetic ball disposed within the bypass portion, and a piston disposed within the chamber. A distal end of the piston blocks the ball from contacting the magnet in a run-in position such that the ball may plug the first bore in response to fluid flow from the tubular toward the annulus. Additionally, the piston is slideable to an open position such that the magnet may hold the ball out of a flow path between the first bore and the second bore in the bypass portion.

20 Claims, 7 Drawing Sheets

WASHPIPE FREE FEATURE WITH BALL AND MAGNET

BACKGROUND

In the process of completing an oil or gas well, a tubular is run downhole into a wellbore and used to direct produced hydrocarbon fluids from a downhole formation to the surface. Typically, this tubular is coupled to a flow regulating system that has a screen assembly that controls and limits debris, such as gravel, sand, and other particulate matter, from entering the tubular as the fluid passes through the screen assembly. The flow regulating system generally also includes an inflow control device that controls the flow of the fluid into the tubular. Indeed, differences in influx from the reservoir can result in premature water or gas breakthrough, which may leave valuable reserves in the formation. Inflow control devices are designed to improve completion performance and efficiency by balancing inflow throughout the length of a completion. Moreover, flow regulating systems generally include plugs or similar devices that block fluid flow from an annulus of the wellbore to the tubular while the flow regulating system is being positioned downhole. The plugs or similar devices may also restrict flow from the tubular to the annulus such that pressure may be maintained in the tubular for setting packer assemblies. Once set, the plugs or similar devices are generally removed or actuated to allow fluid flow (e.g., production) from the annulus to the tubular. Unfortunately, these plugs or similar devices may occasionally fail, which may prevent production from flowing into the tubular. As such, a system is needed that may still allow for production despite component failure, which may improve overall production efficiency.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein is a washpipe free feature of a lower completion assembly having various components for blocking fluid flow from a central bore of a tubular toward an annulus of the wellbore as the lower completion assembly is run-in-hole while still permitting fluid flow from the annulus to the central bore of the tubular. In particular, the washpipe free feature includes a piston held in a run-in position as the lower completion assembly is run-in-hole, which blocks a ball from contacting a magnet such that the ball may be moveable within a bypass portion of the chamber of the washpipe free feature to seal a first bore and block fluid flow from a central bore toward the annulus. Moreover, fluid flow from the annulus to the tubular may at least partially flow due to an interface between the ball and a second bore. Further, the washpipe free feature is configured to shift the piston once the lower completion assembly is positioned downhole such that the magnet may hold the ball away from the of the first bore and the second bore to permit open flow through the bypass portion of the chamber, which may increase the efficiency of production operations and allow injection.

Figure 1:
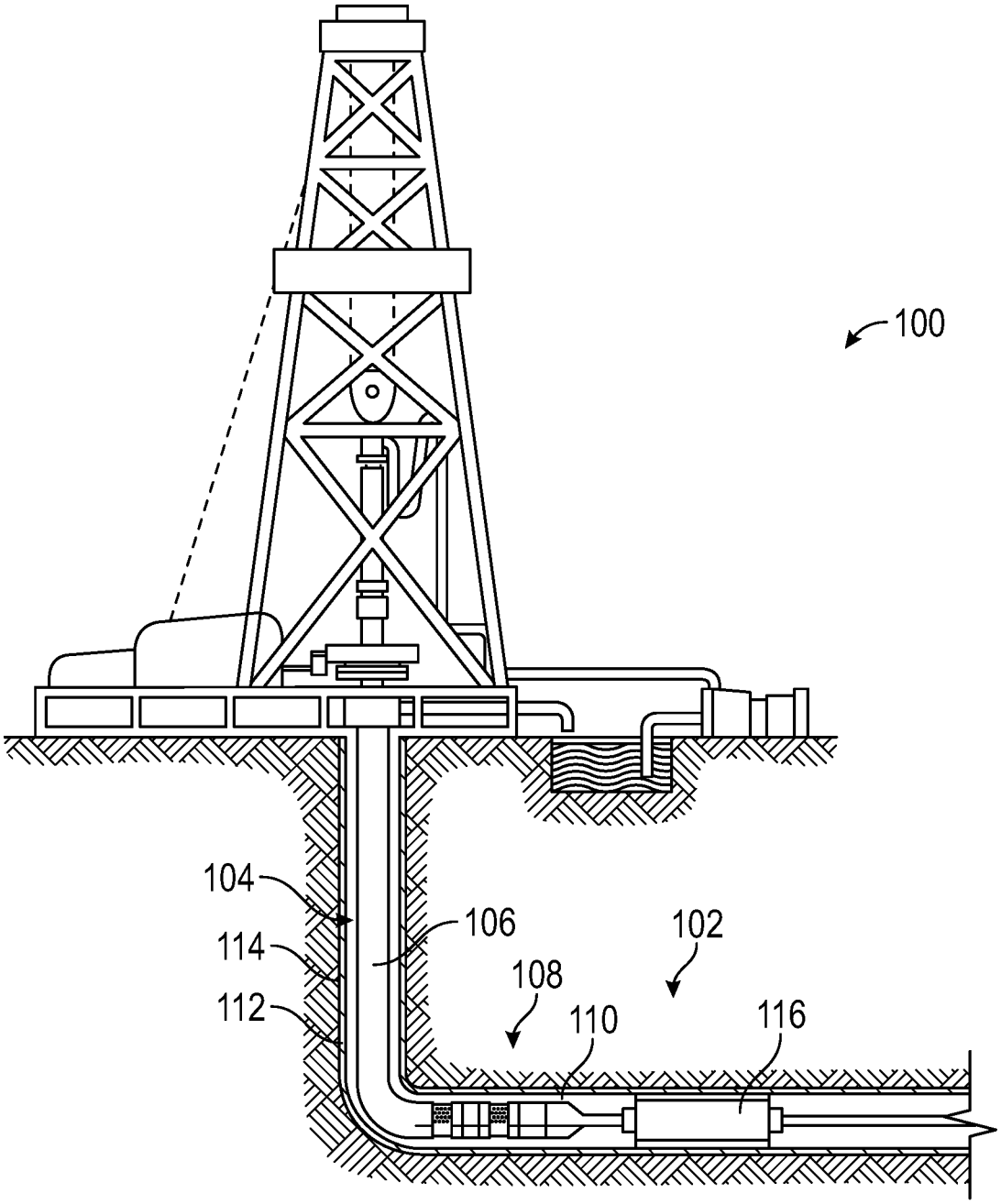
FIG. 1 illustrates a side elevation, partial cross-sectional view of an operational environment for a wellbore completion system, in accordance with some embodiments of the present disclosure.

FIG. 1 illustrates a side elevation, partial cross-sectional view of an operational environment for a wellbore completion system, in accordance with some embodiments of the present disclosure. As illustrated, the wellbore completion system 100 may include a lower completion assembly 102 that is run into a wellbore 104 via a tubular 106 or other suitable conveyance. The lower completion assembly 102 includes at least one flow regulating system 108 for controlling fluid flow between an annulus 110 of the wellbore 104 and a central bore of the tubular 106. As illustrated, the annulus 110 may be formed between the tubular 106 and a casing 112 cemented to against a wellbore wall 114. In some embodiments, the annulus 110 may be formed between the tubular 106 and the wellbore wall 114. Further, the lower completion assembly 102 may include a packer assembly 116, a latch subassembly, or any other suitable assembly.

As set forth in detail below, the at least one flow regulating system 108 may permit at least partial fluid flow from the annulus 110 to the tubular 106 as the lower completion assembly 102 is run-in-hole. However, the at least one flow regulating system 108 may restrain fluid flow from the tubular 106 to the annulus 110 as the lower completion assembly 102 is run-in-hole. Once the lower completion assembly 102 is positioned at a desired location in the wellbore 104, fluid may be pumped through the tubular 106 toward the packer assembly 116. The pressure inside the tubular may increase to a setting pressure for actuating the packer assembly 116. Additionally, the setting pressure in the tubular 106 may actuate the flow regulating system 108 such that the flow regulating system 108 allows open fluid flow between the annulus 110 and the tubular 106. As such, fluids may flow openly through the flow regulating system 108 during production operations.

Figure 2:
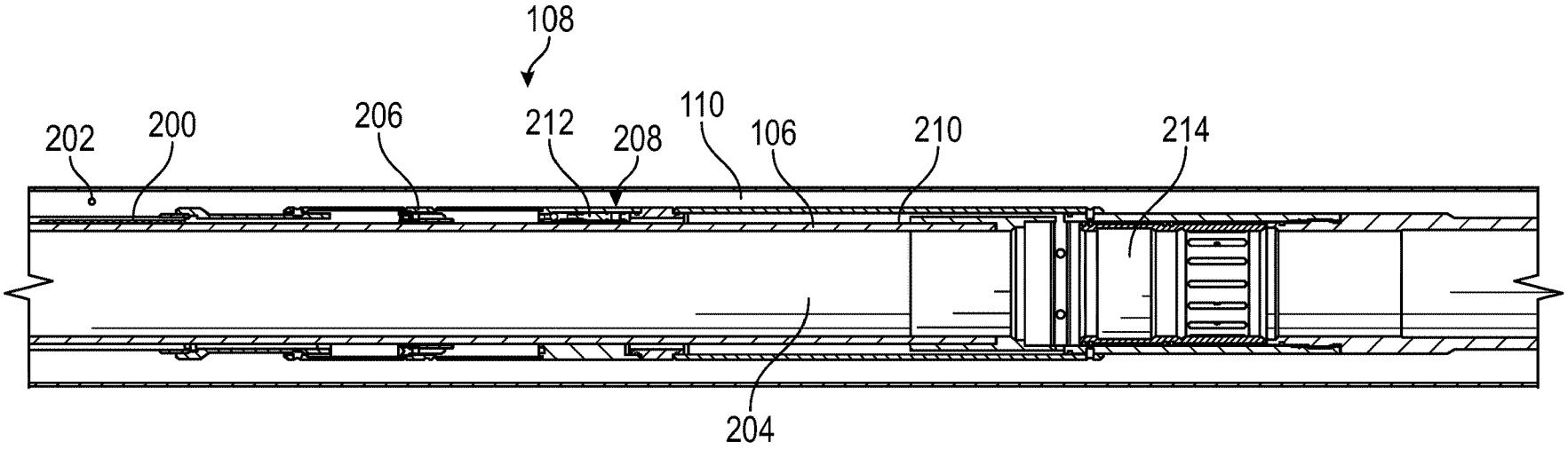
FIG. 2 illustrates a cross-sectional view of a flow regulating system coupled to a tubular that is run-in-hole during completion operations, in accordance with some embodiments of the present disclosure.

FIG. 2 illustrates a cross-sectional view of a flow regulating system coupled to a tubular that is run-in-hole during completion operations, in accordance with some embodiments of the present disclosure. The flow regulating system 108 comprises various components for controlling the fluid flow between the annulus 110 and the tubular 106. For example, as illustrated, the flow regulating system 108 may include a plurality of screens 200 disposed about the tubular 106. The screens 200 are configured to filter debris 202 (e.g., as gravel, sand, and other particulate matter) out of the fluid flowing into a central bore 204 of the tubular 106 from the annulus 110, as debris 202 in the tubular 106 may adversely affect production operations.

Further, the flow regulating system 108 may include an adjustable nozzle inflow control device 206, disposed in a flow path between the plurality of screens 200 and the central bore 204 of the tubular 106, as well as a washpipe free feature 208 disposed in the flow path between the adjustable nozzle inflow control device 206 and the central bore 204 of the tubular 106. The adjustable nozzle inflow control device 206 and the washpipe free feature 208 may be secured to a radially outer surface 210 of the tubular 106 (e.g., completion tubular). As set forth in detail below, a piston 212 of the washpipe free feature 208 may be disposed in a run-in position as the lower completion assembly 102 is run into the wellbore 104. In the run-in position, the washpipe free feature 208 is configured to permit fluid flow from the annulus 110 to the tubular 106 while restraining fluid flow from the tubular 106 to the annulus 110. However, after the lower completion assembly 102 is positioned at a desired location in the wellbore 104 and the pressure inside the tubular is increased to the setting pressure, a pressure differential in the washpipe free feature 208 may shift the piston 212 to an open position such that fluid may flow through the washpipe free feature 208 in both directions.

The washpipe free feature may assist in setting the packer assembly. For example, the lower completion assembly may be run-in-hole with the tubular plugged from below. As the lower completion assembly is run-in-hole, wellbore fluid may flow into the tubular via the washpipe free feature. Because the tubular is already plugged from below and the tubular is filled with wellbore fluid via the washpipe free feature, the pressure in the tubular may be immediately increased to set the packer assembly once the lower completion assembly is in the desired location in the wellbore.

Moreover, the flow regulating system 108 may include a sliding sleeve door 214 disposed in the flow path between the washpipe free feature 208 and the central bore 204 of the tubular 106. The sliding sleeve door 214 has an open position and a closed position. As the lower completion assembly 102 is run-in-hole, the sliding sleeve door 214 is generally set in an open position such that fluid may flow between the annulus 110 and the tubular 106. The sliding sleeve door 214 may be shifted between the open position to the closed position (e.g., to block fluid flow through the flow regulating system 108) using a tool that is lowered downhole to the lower completion assembly 102 via wireline. As such, shifting the sliding sleeve door between the open position and the closed position may be time consuming. For at least this reason, the washpipe free feature 208 is configured to restrain fluid flow from the tubular 106 to the annulus 110 in the run-in position. That is, the washpipe free feature 208 may restrain fluid flow from the tubular 106 to the annulus 110 such that the sliding sleeve door 214 may remain open while the lower completion assembly 102 is run-in-hole and so production operations do not need to be delayed (e.g., to lower the tool) to shift the sliding sleeve door 214 to the closed position for setting the packer assembly 116. Accordingly, the sliding sleeve door 214 may remain open during the installation process and may instead be shifted between the open position and the closed position to control production flow during production operations.

Figure 3:
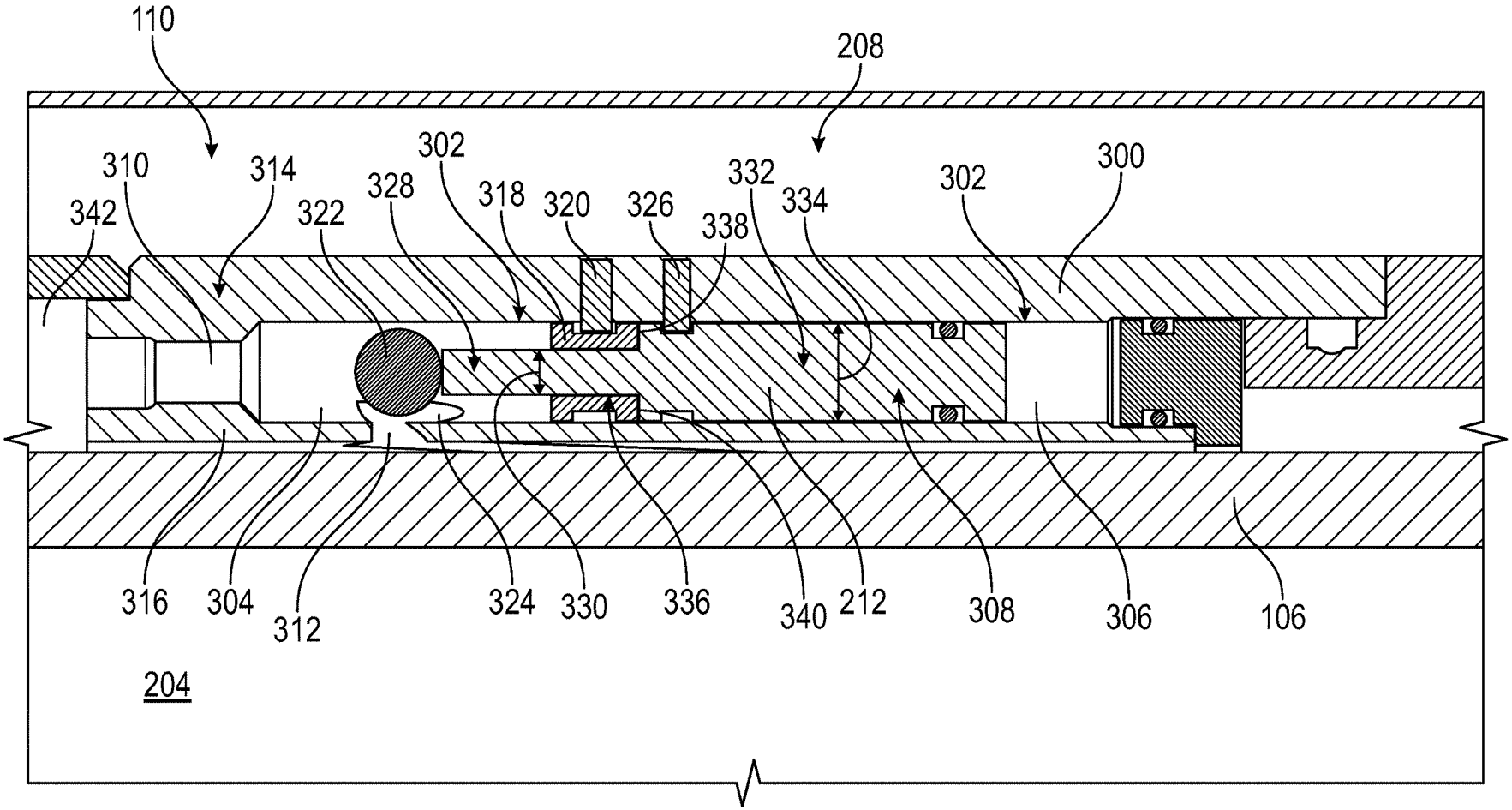
FIG. 3 illustrates a cross-sectional view of a washpipe free feature of the flow regulating system in a run-in position and with fluid flowing from an annulus of a wellbore toward a central bore of the tubular, in accordance with some embodiments of the present disclosure.

FIG. 3 illustrates a cross-sectional view of a washpipe free feature of the flow regulating system in a run-in position and with fluid flowing from an annulus of a wellbore toward a central bore of the tubular, in accordance with some embodiments of the present disclosure. As illustrated, the washpipe free feature 208 includes a housing 300 that may be secured about the tubular 106. The housing 300 defines a chamber 302 having a bypass portion 304 and a securing portion 306. As set forth above, the washpipe free feature 208 also includes the piston 212, which isolates the bypass portion 304 from the securing portion 306. In the illustrated embodiment, the piston 212 is secured in the run-in position 308 such that the bypass portion 304 and securing portion 306 of the chamber 302 each have a constant volume. However, as set forth in detail below, the piston 212 is slidable from the run-in position 308 to an open position (shown in FIG. 5). As the piston 212 slides toward the open position, the volume of the bypass portion 304 of the chamber 302 may increase and the volume of the securing portion 306 of the chamber 302 may decrease since the chamber 302 has a constant volume.

Moreover, the bypass portion 304 of the chamber 302 may be in fluid communication with the annulus 110 and the central bore 204 of the tubular 106. In particular, the housing 300 has a first bore 310 to put the bypass portion 304 of the chamber 302 in fluid communication with an annulus 110 of the wellbore 104 and a second bore 312 to put the bypass portion 304 in fluid communication with a central bore 204 of the tubular 106. The first bore 310 extends through a first axial end 314 of the housing 300 to put the bypass portion 304 of the chamber 302 in fluid communication with adjustable nozzle inflow control device 206 (shown in FIG. 2). Specifically, the first bore 310 puts the bypass portion 304 of the chamber 302 in fluid communication with a flow path 342 extending between the adjustable nozzle inflow control device 206 and the bypass portion 304 of the chamber 302. In some embodiments, the first bore 310 may extend through a radial wall 316 of the housing 300 to put the bypass portion 304 of the chamber 302 in communication with the flow path 342 to the adjustable nozzle inflow control device 206. Further, as set forth above, the adjustable nozzle inflow control device 206 is in fluid communication with the plurality of screens 200 (shown in FIG. 2), which are in direct fluid communication with the annulus 110. As such, the bypass portion 304 of the chamber 302 may be in fluid communication with the annulus 110 via the first bore 310.

Further, in the illustrated embodiment, the second bore 312 extends through the radial wall 316 of the housing 300 to put the bypass portion 304 of the chamber 302 in fluid communication with the central bore 204 of the tubular 106. Alternatively, the second bore 312 may extend through an axial end of the housing 300. For example, in some embodiments, the second bore 312 may extend through the first axial end 314 of the housing 300 and the first bore 310 may extend through a radial wall 316 of the housing 300. Indeed, the second bore 312 may extend through any suitable portion of the housing 300 to put the bypass portion 304 of the chamber 302 in fluid communication with the central bore 204 of the tubular 106. Moreover, as set forth above, the second bore 312 is in fluid communication with the sliding sleeve door 214 (shown in FIG. 2), via another flow path extending between the sliding sleeve door 214 and the bypass portion 304 of the chamber 302, and the sliding sleeve door 214 is in direct fluid communication with the tubular 106 (shown in FIG. 2). As such, the bypass portion 304 of the chamber 302 may be in fluid communication with the central bore 204 of the tubular via the second bore 312.

The washpipe free feature 208 further includes a magnet 318 secured within the bypass portion 304 of the chamber 302. In the illustrated embodiment, the magnet 318 is secured to an inner surface of the bypass portion 304 of the chamber 302 via at least one fastener 320 (e.g., screw, pin, adhesive). Alternatively, the magnet 318 may be press-fit, welded, or otherwise secured within the chamber 302. Further, the magnet 318 may be positioned in the bypass portion 304 of the chamber 302 between the second bore 312 and the securing portion 306 of the chamber 302. As illustrated, the first bore 310 is formed in the first axial end 314 of the housing 300 and the second bore 312 is formed in the radial wall 316 of the housing 300 in a position between the first bore 310 and the magnet 318. Moreover, the magnet 318 may include any suitable permanent magnet or electromagnet. For example, the magnet 318 may comprise a rare earth metal magnet (e.g., or samarium cobalt, neodymium, etc.), which provides the benefit of maintaining a magnetic field without an external power source. Further, the magnet 318 may be coated or otherwise isolated from the fluid in the bypass portion 304 of the chamber 302. In some embodiments, the magnet 318 may comprise a material that is not chemically compatible with the fluids in the bypass portion 304. As such, the magnet 318 may be coated or otherwise isolated to prevent undesired chemical reactions between the magnet 318 and the fluid.

The washpipe free feature 208 additionally includes a ball 322 disposed within the bypass portion 304 of the chamber 302. The ball 322 comprises a ferromagnetic material (e.g., ferromagnetic metal) such that the magnet 318 may hold the ball 322 once the ball 322 comes in contact with the magnet 318. In the run-in position, the piston 212 is configured to block the ball 322 from contacting the magnet 318 such that the ball 322 may be moveable within the bypass portion 304 of the chamber 302. In particular, the ball 322 may move within the bypass portion 304 of the chamber 302 in response to fluid flow through the bypass portion 304 of the chamber 302. For example, in the illustrated embodiment, fluid is flowing from the annulus 110 toward the central bore 204 of the tubular. That is, fluid is flowing from the first bore 310 toward the second bore 312. As such, the ball 322 may be driven to sit over the second bore 312 in response to the fluid flow from the annulus 110 toward the tubular 106. Such fluid flow may also drive the ball 322 toward the magnet 318. However, in the run-in position 308, the piston 212 may stop movement of the ball 322 at the second bore 312. With the ball 322 sitting over the second bore 312, the ball 322 may partially block the second bore 312. However, the second bore 312 may be shaped such that fluid may still flow from the annulus 110 to the tubular 106 with the ball 322 over the second bore 312. For example, the second bore 312 may have a non-circular cross-sectional shape to prevent the ball 322 from plugging the second bore 312. Fluid may continue to flow through a gap(s) 324 between the ball 322 and the second bore 312. As such, at least partial fluid flow may be maintained through the second bore 312 toward the tubular 106 with the ball 322 positioned over the second bore 312.

In the illustrated embodiment, the washpipe free feature 208 further includes at least one shear feature 326 configured to restrain sliding of the piston 212 and hold the piston 212 in the run-in position 308. The at least one shear feature 326 may include at least one shear screw, at least one shear pin, at least one shear ring, or any suitable shear mechanism. In some embodiments, the shear feature 326 may include a combination of shear mechanisms. Moreover, in the run-in position, a distal end of the piston 212 is configured to interface with the ball 322 to block the ball 322 from contacting the magnet 318 such that the ball 322 is moveable within the bypass portion 304 of the chamber 302. As illustrated, the distal end of the piston 212 may extend through the magnet 318 to interface with the ball 322 in the run-in position 308. Specifically, the magnet 318 may comprise a hollow cylindrical shape. Further, the piston 212 may have a stepped diameter with a distal end 328 of the piston 212 having a first diameter 330 and a proximal end 332 of the piston 212 having a second diameter 334. The first diameter 330 is smaller than the second diameter 334. The distal end 328, having the smaller diameter, extends through and protrudes from a central through bore 336 of the magnet 318 to block the ball 322 from contacting the magnet 318 in the run-in position 308. Further, as set forth above, the distal end 328 is configured to retract into the central through bore 336 of the magnet 318 as the piston 212 slides toward the open position. Moreover, in some embodiments, a shoulder 338 is formed at the transition between the first diameter 330 and the second diameter 334, which may contact an axial end 340 of the magnet 318 in the run-in position 308.

Figure 4:
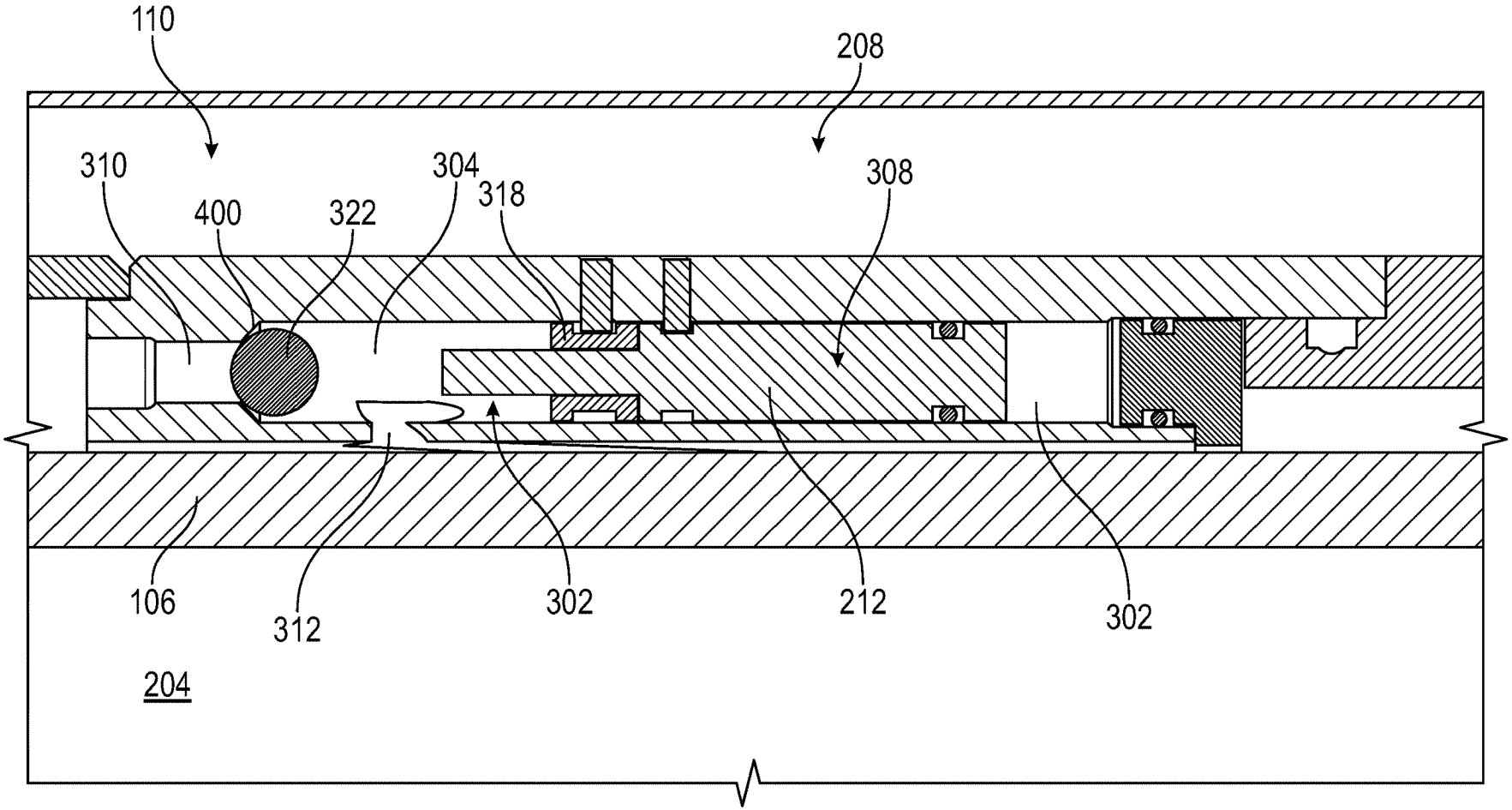
FIG. 4 illustrates a cross-sectional view of the washpipe free feature in the run-in position and with fluid flowing from the tubular toward the annulus, in accordance with some embodiments of the present disclosure.

FIG. 4 illustrates a cross-sectional view of the washpipe free feature in the run-in position and with fluid flowing from the tubular toward the annulus, in accordance with some embodiments of the present disclosure. As set forth above, the washpipe free feature 208 includes the ball 322 disposed within the bypass portion 304 of the chamber 302. In the run-in position 308, the piston 212 blocks the ball 322 from contacting the magnet 318 such that the ball 322 may be moveable within the bypass portion 304 of the chamber 302. In particular, the ball 322 may move within the bypass portion 304 of the chamber 302 in response to fluid flow through the bypass portion 304 of the chamber 302. For example, in the illustrated embodiment, fluid is flowing from the central bore 204 of the tubular 106 toward the annulus 110. That is, fluid is flowing from the second bore 312 toward the first bore 310. As such, the ball 322 may be driven to sit over the first bore 310 in response to the fluid flow from the annulus 110 toward the tubular 106. In the illustrated embodiment, the first bore 310 comprises a seat 400 configured to receive the ball 322 in response to fluid flowing from the tubular 106 toward the annulus 110. With the ball 322 sitting over the first bore 310, the ball 322 may plug the first bore 310 to prevent fluid flow from the first bore 310 toward the annulus 110.

As set forth above, after the lower completion assembly 102 (shown in FIG. 1) is positioned at a desired location in the wellbore 104, the pressure inside the tubular 106 may be increased to the setting pressure for actuating the packer assembly 116 (shown in FIG. 1). However, fluid flowing through the first bore 310 toward the annulus 110 may act as a pressure drop that may increase a needed fluid flow to achieve the setting pressure. As such, preventing fluid flow from the first bore 310 toward the annulus 110, via blocking the first bore 310 with the ball 322, may assist in raising the pressure in the tubular 106 to the setting pressure. Further, preventing fluid flow from the first bore 310 toward the annulus 110 may raise the pressure in the bypass portion 304 of the chamber 302 to a threshold pressure for shifting the piston 212 from the run-in position 308 to the open position (shown in FIG. 5).

Figure 5:
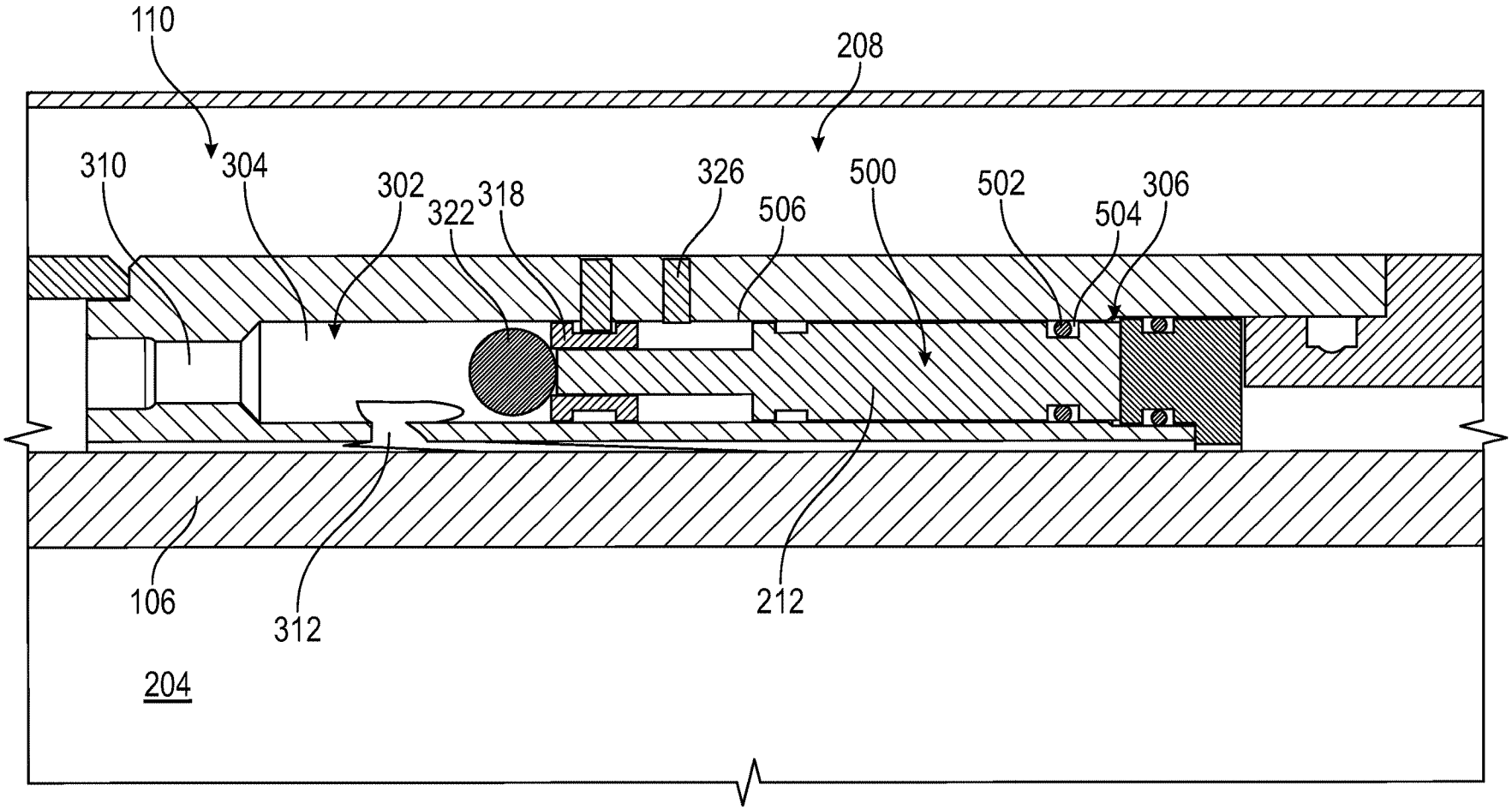
FIG. 5 illustrates a cross-sectional view of the washpipe free feature in an open position, in accordance with some embodiments of the present disclosure.

FIG. 5 illustrates a cross-sectional view of the washpipe free feature in an open position, in accordance with some embodiments of the present disclosure. As set forth above, the at least one shear feature 326 (e.g., shear screw, shear pin, shear ring, etc.) is configured to hold the piston 212 in the run-in position (shown in FIG. 3). However, in response to flow fluid from the central bore 204 of the tubular 106 toward the annulus 110, the ball 322 may be driven to sit over the first bore 310 in response to the fluid flow from the annulus 110 to the tubular 106 and plug the first bore 310 to prevent fluid flow from the first bore 310 toward the annulus 110. With the first bore 310 blocked, the pressure inside the bypass portion 304 of the chamber 302 may increase as the pressure inside the tubular 106 is increased to the setting pressure for actuating the packer assembly 116 (shown in FIG. 1). As illustrated, once the pressure in the bypass portion 304 of the chamber 302 increases to a predetermined threshold pressure, the piston 212 is configured to shear the at least one shear feature 326 and slide to the open position 500. The threshold pressure in the bypass portion 304 of the chamber 302 may be based at least in part on a pressure in the securing portion 306 of the chamber 302. Indeed, the pressure differential between the bypass portion 304 and the securing portion 306 of the chamber 302 may be configured to drive the piston 212 toward the securing portion 306 of the chamber 302, which may shear the at least one shear feature 326 and slide the piston 212 to the open position 500.

As set forth above, the bypass portion 304 may be isolated from the securing portion 306 of the chamber 302 via the piston 212. The washpipe free feature 208 may also include at least one piston seal 502 disposed about a radially outer surface 504 of the piston 212 to seal the piston 212 against an inner surface 506 of the chamber 302 and to help isolate the bypass portion 304 from the securing portion 306 of the chamber 302. The at least one piston seal 502 may include any suitable type of seal. Moreover, the securing portion 306 of the chamber 302 may house a fluid held at atmospheric pressure or vacuum. The at least one piston seal 502 may help hold the securing portion 306 of the chamber 302 at atmospheric pressure or vacuum as the lower completion assembly 102 is run-in-hole. Holding the securing portion 306 of the chamber at atmospheric pressure may be beneficial as it would generally result in a lower threshold pressure needed to drive the piston 212 to the open position 500. That is, pressure in the wellbore (e.g., annulus pressure) is higher than atmospheric pressure. Thus, to achieve a sufficient pressure differential to shear the at least one shear feature 326, a higher threshold pressure in the bypass portion 304 of the chamber 302 would be required.

In the illustrated embodiment, the piston 212 is disposed in the open position 500. The pressure differential between the bypass portion 304 and the securing portion 306 may hold the piston 212 in the open position. With the piston 212 in the open position, the distal end 328 of the piston 212 may no longer block the ball 322 from contacting the magnet 318. Fluid flow through the bypass portion 304 of the chamber 302 may drive the ball 322 into contact with the magnet 318. As the ball 322 comprises ferromagnetic metal, the magnet 318 may hold the ball 322 out of the flow path between the first bore 310 and the second bore 312 in the bypass portion 304 of the chamber 302 such fluid may flow openly through the bypass portion 304 of the chamber 302 of the washpipe free feature 208. For example, production fluid may flow through the bypass portion 304 of the chamber 302 from the first bore 310 toward the second bore 312. With the ball 322 held by the magnet 318 (e.g., not seated over the second bore 312), the production fluid may flow through the second bore 312 uninhibited by the ball 322, which may increase the efficiency of production operations, as well as allow injection from the tubular 106 to the annulus 110.

Figure 6:
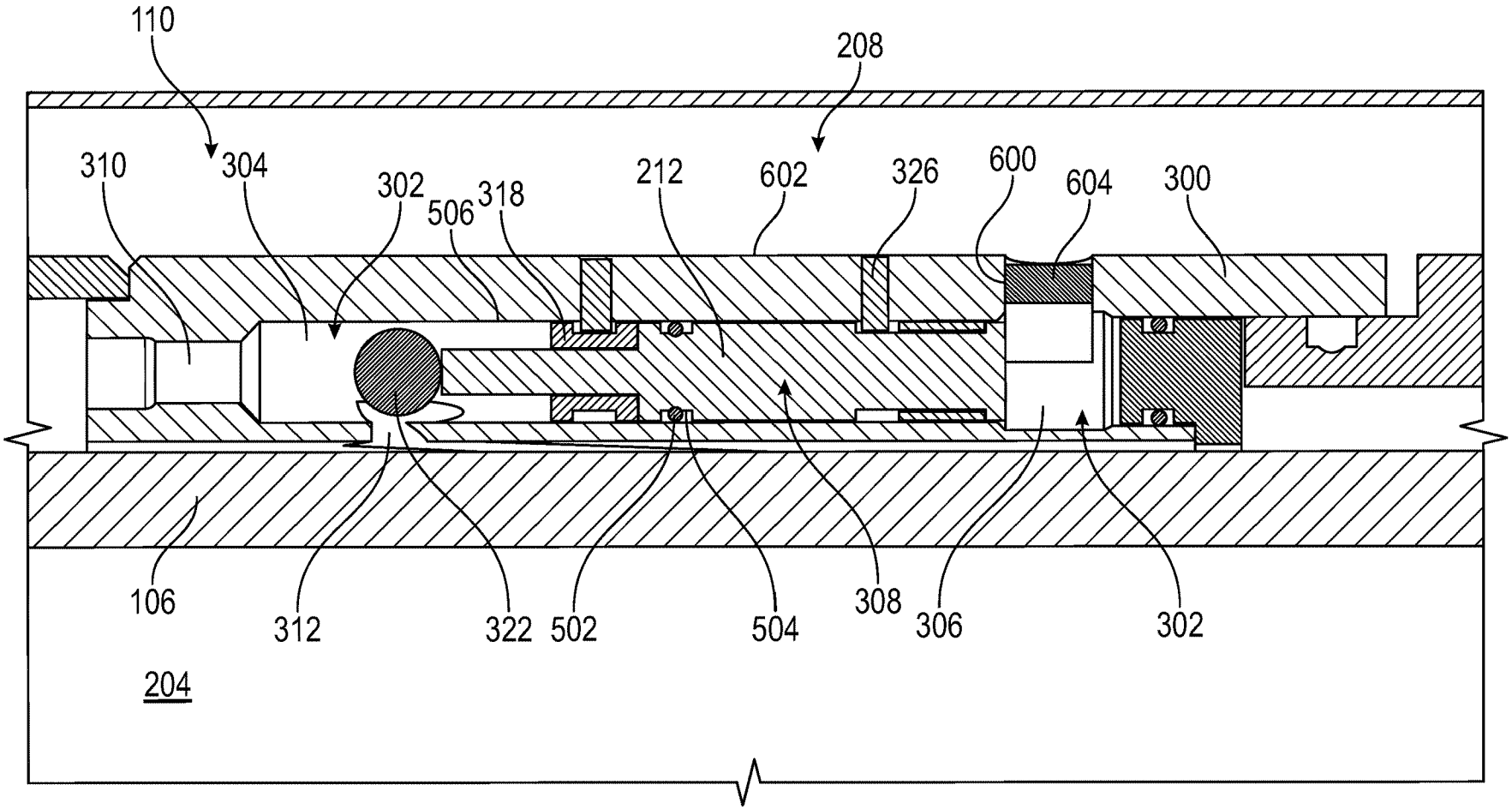
FIG. 6 illustrates a cross-sectional view of another washpipe free feature having an additional bore, in accordance with some embodiments of the present disclosure.

FIG. 6 illustrates a cross-sectional view of another washpipe free feature having an additional bore, in accordance with some embodiments of the present disclosure. In the illustrated embodiment, the washpipe free feature 208 includes the housing 300 that may be secured about the tubular 106. The housing 300 defines the chamber 302 having the bypass portion 304 and the securing portion 306. The washpipe free feature 208 also includes the piston 212, which isolates the bypass portion 304 from the securing portion 306. Further, the washpipe free feature 208 may include the at least one piston seal 502 disposed about the radially outer surface 504 of the piston 212 to seal the piston 212 against the inner surface 506 of the chamber 302 and to help isolate the bypass portion 304 from the securing portion 306 of the chamber 302. As set forth above, the securing portion 306 of the chamber 302 may house a fluid held at atmospheric pressure. However, in the illustrated embodiment, the securing portion 306 of the chamber 302 is in fluid communication with the annulus 110 such that the pressure in the securing portion 306 of the chamber 302 is substantially at annulus pressure.

As illustrated, the housing 300 may comprise a third bore 600 (e.g., the additional bore) formed in the securing portion 306 of the chamber 302. The third bore 600 may extend from the securing portion 306 of the chamber 302 to an outer surface 602 of the housing 300, which may be exposed to the annulus 110. As such, the securing portion 306 of the chamber 302 may be in fluid communication with the annulus 110 via the third bore 600. Further, the washpipe free feature 208 may include a debris barrier 604 positioned within the third bore 600 to block debris 202 from passing from the annulus 110 into the securing portion 306 of the chamber 302. Having debris in the securing portion of the chamber 302 may prevent the piston 212 from sliding to the open position 500. As such, the debris barrier 604 may help maintain desired operation of the washpipe free feature 208.

In the illustrated embodiment, the piston 212 is held in the run-in position via the at least one shear feature 326. As such, the piston 212 may block the ball 322 from contacting the magnet 318 such that the ball 322 may be moveable within the bypass portion 304 of the chamber 302 in response to fluid flow through the bypass portion 304 of the chamber 302. Further, as illustrated, fluid is flowing from the annulus 110 toward the central bore 204 of the tubular 106 (e.g., from the first bore 310 toward the second bore 312), which drives the ball 322 to sit over the second bore 312. However, as set forth above, fluid may still flow from the annulus 110 to the tubular 106 with the ball 322 over the second bore 312. However, after the lower completion assembly 102 is positioned at a desired location in the wellbore 104, the pressure inside the tubular 106 may be increased to the setting pressure for actuating the packer assembly 116, which may reverse the flow such that the fluid may flow from the tubular 106 toward the annulus 110. In response, the ball 322 may be driven to plug the first bore 310, which may prevent fluid flow from the first bore 310 toward the annulus 110. Preventing fluid flow from the first bore 310 toward the annulus 110 may raise the pressure in the bypass portion 304 of the chamber 302 to the threshold pressure for shifting the piston 212 from the run-in position 308 to the open position 500.

Figure 7:
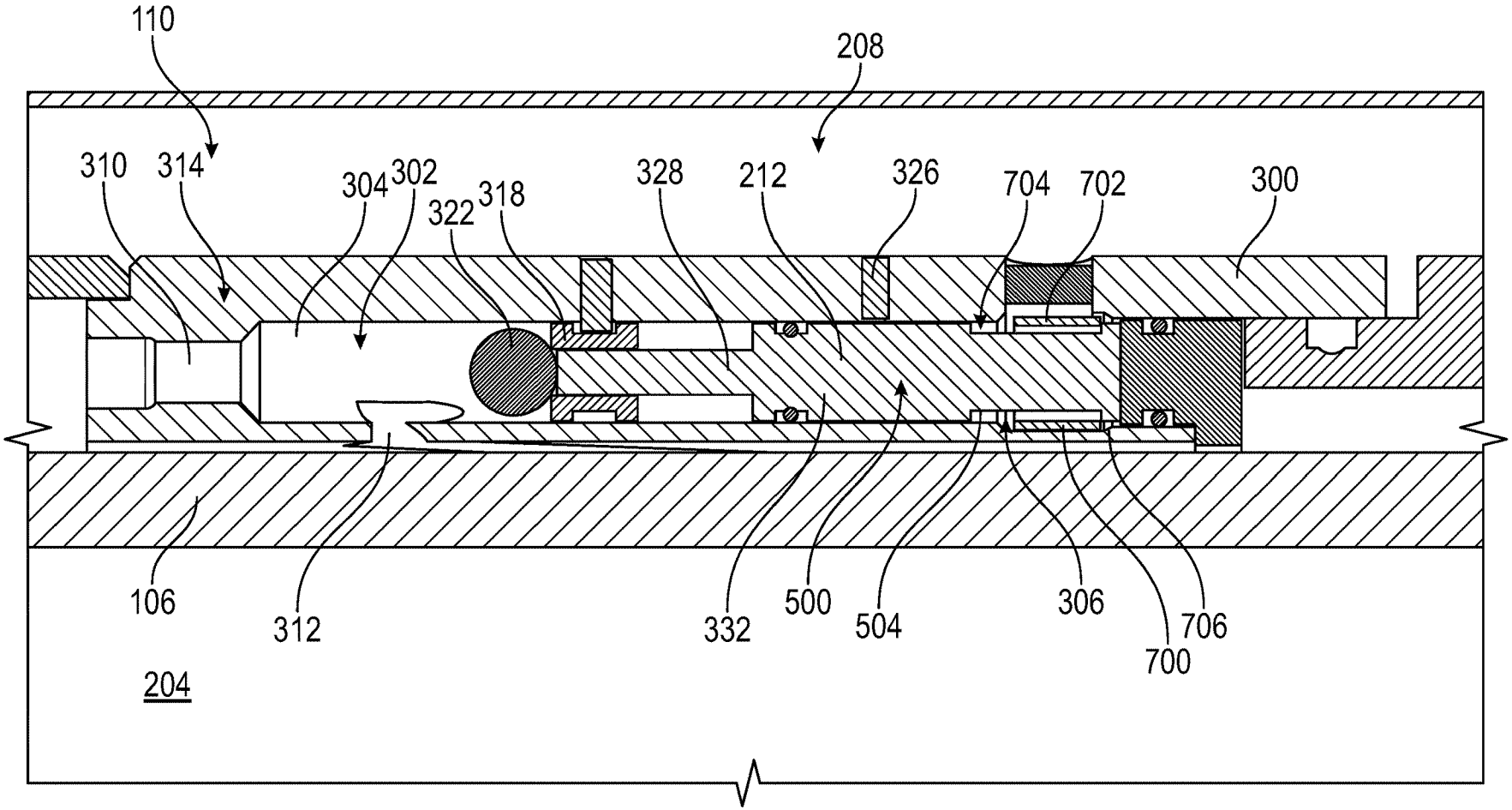
FIG. 7 illustrates a cross-sectional view of a locking feature securing a piston of the washpipe free feature in the open position, in accordance with some embodiments of the present disclosure.

FIG. 7 illustrates a cross-sectional view of a locking feature securing a piston of the washpipe free feature in the open position, in accordance with some embodiments of the present disclosure. As set forth above, the at least one shear feature 326 (e.g., shear screw, shear pin, shear ring, etc.) is configured to hold the piston 212 in the run-in position 308 (shown in FIG. 6). However, in response to flow fluid from the central bore 204 of the tubular 106 toward the annulus 110, the ball 322 may be driven to sit over the first bore 310 in response to the fluid flow from the annulus 110 to the tubular 106 and plug the first bore 310 to prevent fluid flow from the first bore 310 toward the annulus 110. With the first bore 310 blocked, the pressure inside the bypass portion 304 of the chamber 302 may increase as the pressure inside the tubular 106 is increased to the setting pressure for actuating the packer assembly 116. As illustrated, once the pressure in the bypass portion 304 of the chamber 302 increases to a threshold pressure, the piston 212 is configured to shear the at least one shear feature 326 and slide to the open position 500. The threshold pressure in the bypass portion 304 of the chamber 302 may be based at least in part on a pressure in the securing portion 306 of the chamber 302. Indeed, the pressure differential between the bypass portion 304 and the securing portion 306 of the chamber 302 may be configured to drive the piston 212 toward the securing portion 306 of the chamber 302, which may shear the at least one shear feature 326 and slide the piston 212 to the open position 500. In the illustrated embodiment, the securing portion 306 of the chamber 302 is in fluid communication with the annulus 110. As such, the at least one shear feature 326 may shear based on the pressure differential between the bypass portion 304 and the annulus 110.

Moreover, in the illustrated embodiment, the piston 212 is disposed in the open position 500. The washpipe free feature 208 may include a locking feature 700 configured to hold the piston 212 in the open position 500. As illustrated, the locking feature 700 may comprise a snap ring 702 disposed about a slot 704 formed in the radially outer surface 504 of the piston 212. However, the snap ring 702 may be disposed in any suitable position along the piston 212. Further, the securing portion 306 of the chamber 302 may include an annular recess 706 configured to receive the snap ring 702. As the piston 212 slides from the run-in position into the open position 500, the snap ring 702 may expand into the annular recess 706 to secure the piston 212 in the open position 500. Indeed, after setting the packer assembly 116 (shown in FIG. 1), fluid pumped from the surface into the tubular 106 may be halted such that fluid from the annulus 110 may begin to flow into the tubular 106 via the bypass portion 304 of the chamber 302. Once the fluid from the annulus 110 enters the bypass portion 304 of the chamber 302, the fluid pressure in the bypass portion 304 and the securing portion 306 of the chamber 302 may equalize such that the piston 212 may be free to slide axially within the chamber 302. However, the snap ring 702 is configured to hold the piston 212 in the open position 500 such that the distal end 328 of the piston 212 does not block the ball 322 from contacting the magnet 318 such that the magnet 318 may hold the ball 322 out of the flow path between the first bore 310 and the second bore 312 in the bypass portion 304 of the chamber 302 and fluid may flow openly through the bypass portion 304 of the chamber 302 of the washpipe free feature 208. As set forth above, with the ball 322 held by the magnet 318 (e.g., not seated over the second bore 312), the production fluid may flow through the second bore 312 uninhibited by the ball 322, which may increase the efficiency of production operations.

Moreover, the locking feature 700 may include any suitable feature configured to secure the piston 212 in the open position 500. For example, the locking feature 700 may alternatively include a j-slot formed in the housing 300 proximate the securing portion 306 of the chamber 302. The piston 212 may include a corresponding protrusion extending radially outward from a proximal end 332 of the piston 212. The protrusion may interface with the j-slot to secure the piston 212 in the open position 500. That is, once the piston 212 moves to the open position, the geometry of the j-slot may restrain the protrusion from moving toward the first axial end 314 of the chamber 302, which may hold the piston 212 in the open position 500.

Accordingly, the present disclosure may provide a washpipe free feature of a lower completion assembly having various components for blocking fluid flow from a central bore of a tubular toward an annulus of the wellbore as the lower completion assembly is run-in-hole while still permitting fluid flow from the annulus to the central bore of the tubular in a run-in position. The washpipe free feature may include any of the various features disclosed herein, including one or more of the following statements.

Statement 1. A washpipe free feature, comprising: a housing defining a chamber having a bypass portion and a securing portion, wherein the housing comprises a first bore to put the bypass portion of the chamber in fluid communication with an annulus of a wellbore and a second bore to put the bypass portion in fluid communication with a central bore of a downhole tubular; a magnet secured in the bypass portion of the chamber; a ball disposed within the bypass portion of the chamber, wherein the ball comprises a ferromagnetic metal; and a piston disposed within the chamber, wherein the piston is slidable between a run-in position and an open position, wherein a distal end of the piston blocks the ball from contacting the magnet in the run-in position such that the ball is moveable to plug the first bore in response to fluid flow from the tubular toward the annulus, and wherein the piston slides toward the securing portion of the chamber in the open position such that the magnet may hold the ball out of a flow path between the first bore and the second bore in the bypass portion of the chamber.

Statement 2. The washpipe free feature of statement 1, wherein the ball is moveable in the run-in position to sit over the second bore in response to fluid flow from the annulus to the tubular, wherein the ball at most partially blocks the second bore such that fluid may flow from the annulus to the tubular in the run-in position.

Statement 3. The washpipe free feature of statement 1 or statement 2, wherein the second bore comprises a non-circular cross-sectional shape to prevent the ball from plugging the second bore such that fluid may flow from the annulus to the tubular, via the second bore, with the ball positioned over the second bore.

Statement 4. The washpipe free feature of any preceding statement, further comprising at least one shear feature configured to hold the piston in the run-in position.

Statement 5. The washpipe free feature of any preceding statement, wherein the at least one shear feature is configured to shear in response to a predetermined threshold pressure in the tubular, and wherein the predetermined threshold pressure drives the piston to slide from the run-in position to the open position.

Statement 6. The washpipe free feature of any preceding statement, wherein the securing portion of the chamber houses a fluid at atmospheric pressure or vacuum, wherein as pressure differential between the securing portion and the bypass portion drives the piston toward the open position.

Statement 7. The washpipe free feature of any preceding statement, further comprising at least one piston seal disposed about the piston, wherein the at least one piston seal seals the piston against an inner surface of the chamber to isolate the bypass portion from the securing portion of the chamber.

Statement 8. The washpipe free feature of any preceding statement, wherein the magnet comprises a rare earth metal magnet.

Statement 9. The washpipe free feature of any preceding statement, wherein the magnet comprises a hollow cylindrical shape, wherein a radially outer surface of the magnet contacts an inner surface of the bypass portion of the chamber, and wherein a fastener secures the magnet to the inner surface of the bypass portion.

Statement 10. The washpipe free feature of any preceding statement, wherein the piston comprises a stepped diameter with the distal end of the piston having a first diameter and a proximal end of the piston having a second diameter, wherein the first diameter is smaller than the second diameter, wherein the distal end extends through and protrudes from a central bore of the magnet to block the ball from contacting the magnet in the run-in position, and wherein the distal end is configured to retract into the central bore of the magnet in the open position.

Statement 11. The washpipe free feature of any preceding statement, wherein the first bore extends through a first axial end of the housing, and wherein the first bore comprises a seat configured to receive the ball in response to fluid flowing from the tubular toward the annulus.

Statement 12. The washpipe free feature of any preceding statement, wherein the second bore extends through a radial wall of the housing.

Statement 13. The washpipe free feature of any preceding statement, wherein the second bore is disposed between the first bore and the magnet along an axial length of the chamber.

Statement 14. The washpipe free feature of any preceding statement, wherein the housing is secured to a radially outer surface of the downhole tubular.

Statement 15. A washpipe free feature, comprising: a housing defining a chamber having a bypass portion and a securing portion, wherein the housing comprises a first bore to put the bypass portion of the chamber in fluid communication with an annulus of a wellbore and a second bore to put the bypass portion in fluid communication with a central bore of a downhole tubular; a magnet secured to an inner surface of the bypass portion of the chamber; a ball disposed within the bypass portion of the chamber, wherein the ball comprises a ferromagnetic metal; a piston disposed within the chamber, wherein the piston is slidable between a run-in position and an open position, wherein a distal end of the piston blocks the ball from contacting the magnet in the run-in position such that the ball is moveable to plug the first bore in response to fluid flow from the tubular toward the annulus; at least one shear feature configured to hold the piston in the run-in position, wherein the at least one shear feature is configured to shear in response to a predetermined threshold pressure, wherein a pressure differential between the tubular and the annulus drives the piston slides from the run-in position to the open position such that the magnet may hold the ball out of a flow path between the first bore and the second bore in the bypass portion of the chamber; and a locking feature configured to secure the piston in the open position.

Statement 16. The washpipe free feature of statement 15, wherein the locking feature comprises a snap ring disposed about a slot formed in a radially outer surface of a proximal end of the piston, wherein the securing portion of the chamber comprises an annular recess configured to receive the snap ring, and wherein the snap ring expands into the annular recess in the open position to secure the piston in the open position.

Statement 17. The washpipe free feature of statement 15 or statement 16, wherein the locking feature comprises a j-slot formed in the inner surface of the securing portion of the chamber, wherein the piston comprises a protrusion extending radially outward from a proximal end of the piston, and wherein the protrusion is configured to interface with the j-slot to secure the piston in the open position.

Statement 18. A downhole flow regulating system, comprising: a plurality of screens to filter debris out of fluids flowing through the screens from an annulus of a wellbore toward a central bore of a tubular; and a washpipe free feature disposed in the flow path between the plurality of screens and the central bore of the tubular, wherein the washpipe free feature comprises: a housing defining a chamber having a bypass portion and a securing portion, wherein the housing comprises a first bore to put the bypass portion of the chamber in fluid communication with the annulus of the wellbore and a second bore to put the bypass portion in fluid communication with a central bore of a downhole tubular; a magnet secured to an inner surface of the bypass portion of the chamber; a ball disposed within the bypass portion of the chamber, wherein the ball comprises a ferromagnetic metal; and a piston disposed within the chamber, wherein the piston is slidable between a run-in position and an open position, wherein a distal end of the piston blocks the ball from contacting the magnet in the run-in position such that the ball is moveable to plug the first bore in response to fluid flow from the tubular toward the annulus, and wherein the piston slides toward the securing portion of the chamber in the open position such that the magnet may hold the ball out of the flow path between the first bore and the second bore in the bypass portion of the chamber.

Statement 19. The downhole flow regulating system of statement 18, further comprising an adjustable nozzle inflow control device disposed in the flow path between the plurality of screens and the central bore of the tubular.

Statement 20. The downhole flow regulating system of statement 18 or statement 19, further comprising a sliding sleeve door disposed in a flow path between the washpipe free feature and the central bore of the tubular, wherein the sliding sleeve door has an open position and a closed position, and wherein the sliding sleeve door is set in the open position while run-in-hole to permit fluid flow between the annulus and the tubular.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A washpipe free feature, comprising:

a housing defining a chamber having a bypass portion and a securing portion, wherein the housing comprises a first bore to put the bypass portion of the chamber in fluid communication with an annulus of a wellbore and a second bore to put the bypass portion in fluid communication with a central bore of a downhole tubular, and wherein the securing portion of the chamber houses a fluid at atmospheric pressure or vacuum;

a magnet secured in the bypass portion of the chamber;

a ball disposed within the bypass portion of the chamber, wherein the ball comprises a ferromagnetic metal; and a piston disposed within the chamber, wherein the piston is slidable between a run-in position and an open position, wherein a distal end of the piston blocks the ball from contacting the magnet in the run-in position such that the ball is moveable to plug the first bore in response to fluid flow from the tubular toward the annulus, wherein a pressure differential between the securing portion and the bypass portion drives the piston toward the open position, and wherein the piston slides toward the securing portion of the chamber in the open position to permit the ball to move into contact with the magnet, and wherein the magnet is configured to hold the ball out of a flow path between the first bore and the second bore in the bypass portion of the chamber.

2. The washpipe free feature of claim 1, wherein the ball is moveable in the run-in position to sit over the second bore in response to fluid flow from the annulus to the tubular, wherein the ball at most partially blocks the second bore such that fluid may flow from the annulus to the tubular in the run-in position.

3. The washpipe free feature of claim 1, wherein the second bore comprises a non-circular cross-sectional shape to prevent the ball from plugging the second bore such that fluid may flow from the annulus to the tubular, via the second bore, with the ball positioned over the second bore.

4. The washpipe free feature of claim 1, further comprising at least one shear feature configured to hold the piston in the run-in position.

5. The washpipe free feature of claim 4, wherein the at least one shear feature is configured to shear in response to a predetermined threshold pressure in the tubular, and wherein the predetermined threshold pressure drives the piston to slide from the run-in position to the open position.

6. The washpipe free feature of claim 1, further comprising at least one piston seal disposed about a radially outer surface the piston, wherein the piston is disposed between the securing portion and the bypass portion, and wherein the at least one piston seal seals the radially outer surface of the piston against an inner surface of the chamber to isolate the bypass portion from the securing portion of the chamber.

7. The washpipe free feature of claim 1, wherein the magnet comprises a rare earth metal magnet.

8. The washpipe free feature of claim 1, wherein the magnet comprises a hollow cylindrical shape, wherein a radially outer surface of the magnet contacts an inner surface of the bypass portion of the chamber, and wherein a fastener secures the magnet to the inner surface of the bypass portion.

9. The washpipe free feature of claim 1, wherein the piston comprises a stepped diameter with the distal end of the piston having a first diameter and a proximal end of the piston having a second diameter, wherein the first diameter is smaller than the second diameter, wherein the distal end extends through and protrudes from a central bore of the magnet to block the ball from contacting the magnet in the run-in position, and wherein the distal end is configured to retract into the central bore of the magnet in the open position.

10. The washpipe free feature of claim 1, wherein the first bore extends through a first axial end of the housing, and wherein the first bore comprises a seat configured to receive the ball in response to fluid flowing from the tubular toward the annulus.

11. The washpipe free feature of claim 1, wherein the second bore extends through a radial wall of the housing.

12. The washpipe free feature of claim 1, wherein the second bore is disposed between the first bore and the magnet along an axial length of the chamber.

13. The washpipe free feature of claim 1, wherein the housing is secured to a radially outer surface of the downhole tubular.

14. A washpipe free feature, comprising:

a housing defining a chamber having a bypass portion and a securing portion, wherein the housing comprises a first bore to put the bypass portion of the chamber in fluid communication with an annulus of a wellbore and a second bore to put the bypass portion in fluid communication with a central bore of a downhole tubular;

a magnet secured to an inner surface of the bypass portion of the chamber;

a ball disposed within the bypass portion of the chamber, wherein the ball comprises a ferromagnetic metal;

a piston disposed within the chamber, wherein the piston is slidable between a run-in position and an open position, wherein the piston comprises a stepped diameter with a distal end of the piston having a first diameter and a proximal end of the piston having a second diameter, wherein the first diameter is smaller than the second diameter, wherein a distal end of the piston extends through and protrudes from a central bore of the magnet to blocks the ball from contacting the magnet in the run-in position such that the ball is moveable to plug the first bore in response to fluid flow from the tubular toward the annulus, and wherein the distal end is configured to retract into the central bore of the magnet in the open position;

at least one shear feature configured to hold the piston in the run-in position, wherein the at least one shear feature is configured to shear in response to a predetermined threshold pressure, wherein a pressure differential between the securing portion and the bypass portion drives the piston to slides from the run-in position to the open position to permit the ball to move into contact with the magnet, and wherein the magnet is configured to hold the ball out of a flow path between the first bore and the second bore in the bypass portion of the chamber; and a locking feature configured to secure the piston in the open position.

15. The washpipe free feature of claim 14, wherein the locking feature comprises a snap ring disposed about a slot formed in a radially outer surface of a proximal end of the piston, wherein the securing portion of the chamber comprises an annular recess configured to receive the snap ring, and wherein the snap ring expands into the annular recess in the open position to secure the piston in the open position.

16. The washpipe free feature of claim 14, wherein the locking feature comprises a j-slot formed in the inner surface of the securing portion of the chamber, wherein the piston comprises a protrusion extending radially outward from a proximal end of the piston, and wherein the protrusion is configured to interface with the j-slot to secure the piston in the open position.

17. A downhole flow regulating system, comprising:

a plurality of screens to filter debris out of fluids flowing through the screens from an annulus of a wellbore toward a central bore of a tubular; and a washpipe free feature disposed in the flow path between the plurality of screens and the central bore of the tubular, wherein the washpipe free feature comprises:

a housing defining a chamber having a bypass portion and a securing portion, wherein the housing comprises a first bore to put the bypass portion of the chamber in fluid communication with the annulus of the wellbore and a second bore to put the bypass portion in fluid communication with a central bore of a downhole tubular, and wherein the securing portion of the chamber houses a fluid at atmospheric pressure or vacuum;

a magnet secured to an inner surface of the bypass portion of the chamber;

a ball disposed within the bypass portion of the chamber, wherein the ball comprises a ferromagnetic metal; and a piston disposed within the chamber, wherein the piston is slidable between a run-in position and an open position, wherein a distal end of the piston blocks the ball from contacting the magnet in the run-in position such that the ball is moveable to plug the first bore in response to fluid flow from the tubular toward the annulus, wherein a pressure differential between the securing portion and the bypass portion drives the piston toward the open position, and wherein the piston slides toward the securing portion of the chamber in the open position to permit the ball to move into contact with the magnet, and wherein the magnet is configured to hold the ball out of the flow path between the first bore and the second bore in the bypass portion of the chamber.

18. The downhole flow regulating system of claim 17, further comprising an adjustable nozzle inflow control device disposed in the flow path between the plurality of screens and the central bore of the tubular.

19. The downhole flow regulating system of claim 17, further comprising a sliding sleeve door disposed in a flow path between the washpipe free feature and the central bore of the tubular, wherein the sliding sleeve door has an open position and a closed position, and wherein the sliding sleeve door is set in the open position while run-in-hole to permit fluid flow between the annulus and the tubular.

20. A washpipe free feature, comprising:

a housing defining a chamber having a bypass portion and a securing portion, wherein the housing comprises a first bore to put the bypass portion of the chamber in fluid communication with an annulus of a wellbore and a second bore to put the bypass portion in fluid communication with a central bore of a downhole tubular;

a magnet secured in the bypass portion of the chamber;

a ball disposed within the bypass portion of the chamber, wherein the ball comprises a ferromagnetic metal; and a piston disposed within the chamber, wherein the piston is slidable between a run-in position and an open position, wherein the piston comprises a stepped diameter with a distal end of the piston having a first diameter and a proximal end of the piston having a second diameter, wherein the first diameter is smaller than the second diameter, wherein a distal end of the piston extends through and protrudes from a central bore of the magnet to block the ball from contacting the magnet in the run-in position such that the ball is moveable to plug the first bore in response to fluid flow from the tubular toward the annulus, and wherein the distal end is configured to retract into the central bore of the magnet in the open position, wherein the piston slides toward the securing portion of the chamber in the open position to permit the ball to move into contact with the magnet, and wherein the magnet is configured to hold the ball out of a flow path between the first bore and the second bore in the bypass portion of the chamber.

* * * * *